US006517019B2

(12) United States Patent
Johnson et al.

(10) Patent No.: US 6,517,019 B2
(45) Date of Patent: Feb. 11, 2003

(54) COVER FOR TUB GRINDER

(75) Inventors: Aaron J. Johnson, Jamestown, ND (US); Ronald F. Stoltenberg, Jamestown, ND (US)

(73) Assignee: Duratech Industries International, Inc., Jamestown, ND (US)

( * ) Notice: Subject to any disclaimer, the term of this patent is extended or adjusted under 35 U.S.C. 154(b) by 0 days.

(21) Appl. No.: 09/753,532

(22) Filed: Jan. 2, 2001

(65) Prior Publication Data

US 2002/0084370 A1 Jul. 4, 2002

Related U.S. Application Data

(60) Provisional application No. 60/253,577, filed on Nov. 28, 2000.

(51) Int. Cl.[7] ..... B02C 13/286
(52) U.S. Cl. ..... 241/186.4; 241/101.761
(58) Field of Search ..... 241/101.761, 186.4

(56) References Cited

U.S. PATENT DOCUMENTS 3,966,128 A 6/1976 Anderson et al.
5,375,784 A 12/1994 Worley
5,419,502 A 5/1995 Morey
5,720,440 A 2/1998 Bonner et al.
5,803,380 A 9/1998 Brand et al.
5,950,942 A 9/1999 Brand et al.

OTHER PUBLICATIONS

Gannon U.K. Limited Corrspondence, dated Sep. 30, 1999.
Diamond Z Tub Grinders—web pages—models E600B and E4800B, admitted prior art.
Haybuster Industrial Grinder—IG–10 Parts Book, published Jul. 1990, pp. 46–49.
Haybusher Industrial Grinder—Operator's Manual, published Jul. 1990, pp. 26–29.
Series of pictures for Industrial Grinder with Containment Cover, in public use and on sale at least as early as Jul. 1990.

*Primary Examiner*—Mark Rosenbaum
(74) *Attorney, Agent, or Firm*—Westman, Champlin & Kelly, P.A.

(57) ABSTRACT

A tub grinder is used for grinding industrial wastes, including large stumps, lumber chunks and the like. A cover member is pivoted alongside the tub, and is made in two sections. An upright frame section is pivoted near a plane along the bottom of the tub, and extends upwardly to a level at or adjacent to the top of the tub. A cover section is pivotally mounted to the upright frame and can be adjusted about a generally horizontal axis from a generally horizontal position to an upwardly extending position. The upright frame can be tilted outwardly so that the cover section is out of registry with the tub to permit the tub to be loaded.

14 Claims, 4 Drawing Sheets

COVER FOR TUB GRINDER

CROSS REFERENCE TO RELATED APPLICATION

This application claims priority of U.S. Provisional Application Serial No. 60/253,577, filed Nov. 28, 2000, entitled COVER FOR TUB GRINDER.

BACKGROUND OF THE INVENTION

The present invention relates to a tub grinder that is used for grinding industrial waste, such as stumps, brush, pallets, large timbers, demolition debris, trees and limbs, lumber piles and the like into particulate material that can be easily disposed of, used as a mulch ground cover or other uses, and which has a openable cover that will intercept debris that may be ejected from the open top of the tub during use. The cover, as shown, is mounted in a unique matter so that complete covering of the tub opening can be obtained, and the cover can easily be opened for filling the tub.

In the prior art, various industrial waste tub grinders have been utilized. U.S. Pat. No. 5,419,502 shows such a device. Tub grinders have been used for grinding hay and straw for years.

The assignee of the present application developed and sold a cover or lid for a tub grinder that hinged in a different manner from the present mounting by pivotally mounting the cover along a top edge of the tub. It was used as a containment device and could be adjusted in position with a winch and cable.

Tub grinders use a rotating grinding cylinder that has hammers or flails that are positioned to extend through an opening in the floor of the tub and engage material that is in the tub. The ground material is dropped down through a screen, onto a conveyor, and then conveyed where desired for disposal.

When the tub is partially full, or is being emptied, the material in the tub is at times not sufficient to prevent chunks of material engaged by the grinding cylinder or flails to be thrown through the material outwardly through an open top of the tub. It is during these times when a cover member is desired to intercept the trajectory of chunks or objects, and prevent the chunks from being thrown into the surrounding area.

SUMMARY OF THE INVENTION

The present invention relates to a tub grinder cover that has an upright frame mounted for pivotal movement about a horizontal axis that is adjacent one side of the tub. The upright frame will tilt sideways from a generally vertical position away from the tub. In a preferred form a cover member is pivoted about a second horizontal axis at the upper end of the upright frame. Hydraulic cylinders are used for controlling the pivoting of the upright frame and the cover member about their respective mounting axis.

The cover of the present invention thus easily moves so that the cover can be moved to completely overlie the tub when desired, or moved to a position where the top of the tub is completely open for filling the tub. Additionally, various intermediate positions are possible. Changing the cover position will permit an operator to accommodate the conditions being encountered.

During transport the cover is moved to overlie the tub, and to lie over a folding elevator conveyor that is used for conveying the ground material. The elevator is folded over the top of the tub for transport or storage, and the cover overlies the folded elevator so the transport height required for the tub unit is kept low.

The tub grinders used for industrial waste are large and heavy, and are generally mounted onto semi-trailers and pulled with a truck/tractor between locations.

The present cover is formed with a framework that carries screen panels that can easily be replaced if they become damaged. The screens will permit dust to be discharged without substantial hindrance and also will filter out pieces that are carried into the air. The screen also reduces the tendency of the cover to become a "sail" in windy conditions. The screen reduces the wind load on the cover supports. The wind can pass through easily. The angle of incident of thrown objects causes even small objects to be deflected. If any small objects do pass through the screen, the energy of the small objects is reduced.

DETAILED DESCRIPTION OF THE PREFERRED EMBODIMENTS

Figure 1:
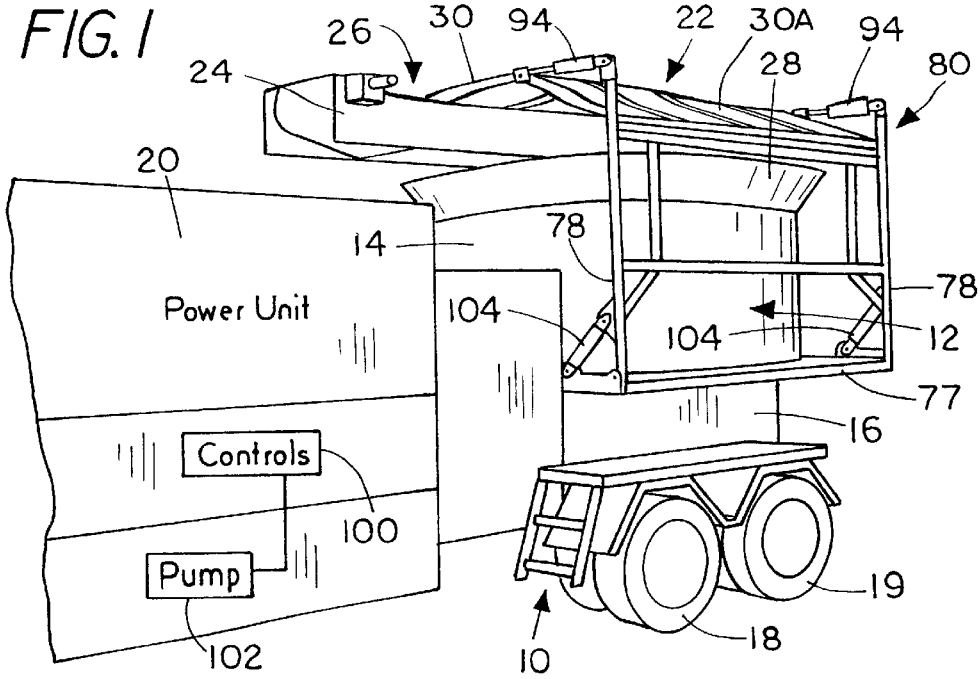
FIG. 1 is a schematic partial perspective view of a tub grinder having a cover member made according to the present invention installed thereon in a storage position.

Referring to FIG. 1, a tub grinder and cover assembly indicated generally at 10 utilizes a conventional tub grinder 12, which has a rotating tub 14 mounted onto a frame 16, and rotatable about an upright axis. The frame 16 is a semi-trailer frame, as shown, and is supported on wheels 18 and pulled by a truck-tractor (not shown). The tub grinder 10 is powered through a large power unit, such as an internal combustion engine 20, that is mounted on the frame 16 and is used for driving the various components.

A tub cover assembly 22 is made so that it will overlie the open top of the tub 14 or can be moved to clear the tub. The cover assembly 22 is shown in its storage position in FIG. 1, with an outer end section 24 of a folding conveyor 26 lying on top of the upper flange edge 28 of the tub and underneath an outer cover section 30.

Figure 4:
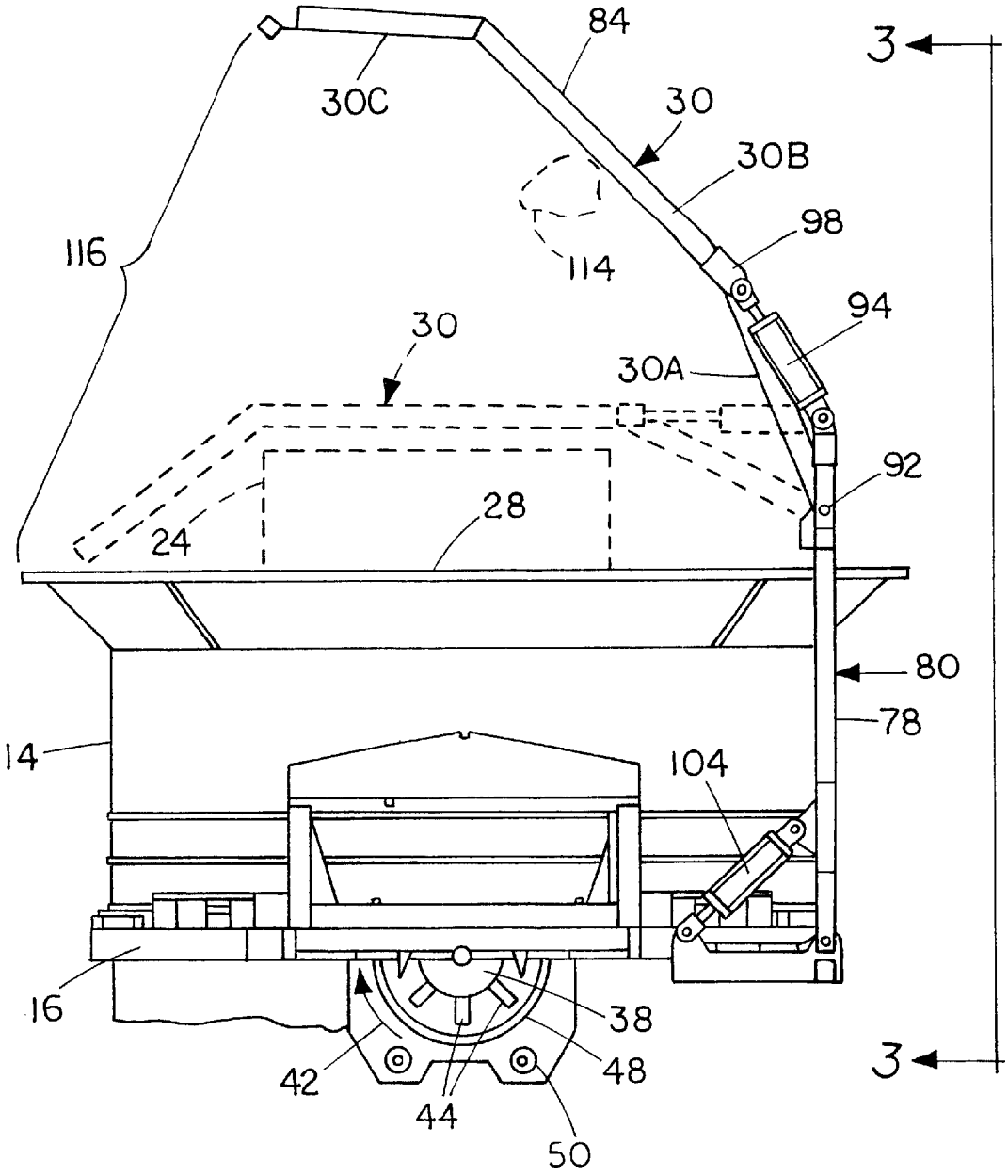
FIG. 4 is a fragmentary front elevational view showing the cover in a first position where the cover section is raised, with an upright support frame in a vertical position, and with a closed position of the cover shown in dotted lines.
Figure 5:
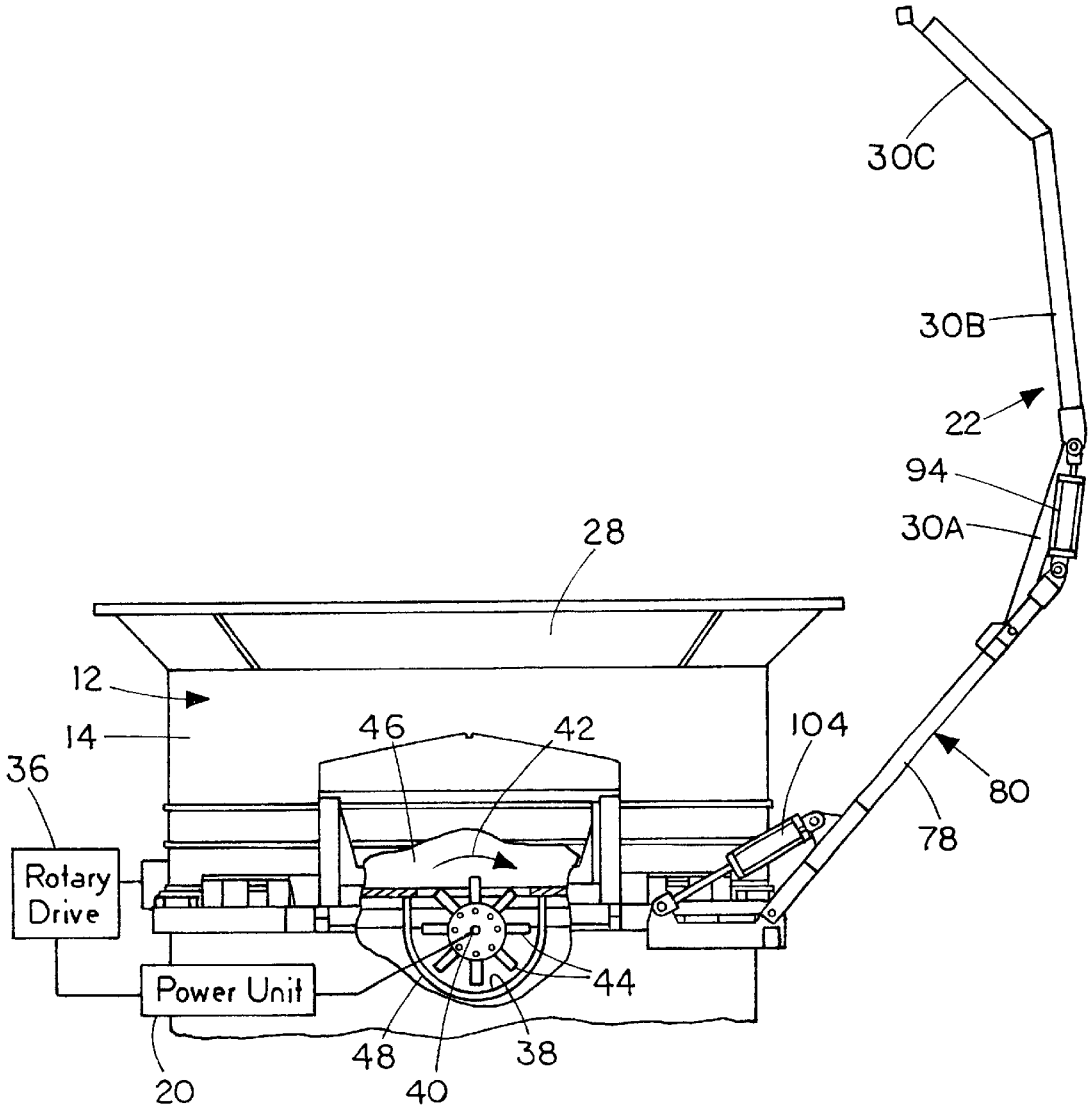
FIG. 5 is a front view showing the cover in a full open position with the support frame inclined outwardly and the cover member in its full open position.

The tub 14 is rotated by a tub drive illustrated schematically in FIGS. 4 and 5. The tub 14, as shown in FIG. 5, rotates over a bottom wall 32 that is stationary. The tub 14 rotates around an upright axis over this bottom wall. The tub 14 is mounted on suitable roller supports 34 in a conventional manner relative to the frame 16, and then is driven with a rotary drive 36 driven from the power unit 20. The drive can be any conventional, presently used tub drive.

A grinding cylinder or rotor similar to a hammer mill is indicated at 38, and is mounted on a central shaft 40 for rotation in direction as indicated by the arrow 42. The grinding cylinder 38 has hammers or flails 44 that will engage material in the tub, shown schematically at 46 in FIG. 5, as it rotates. The shaft 40 is driven from the power unit 20 in a conventional manner.

Figure 3:
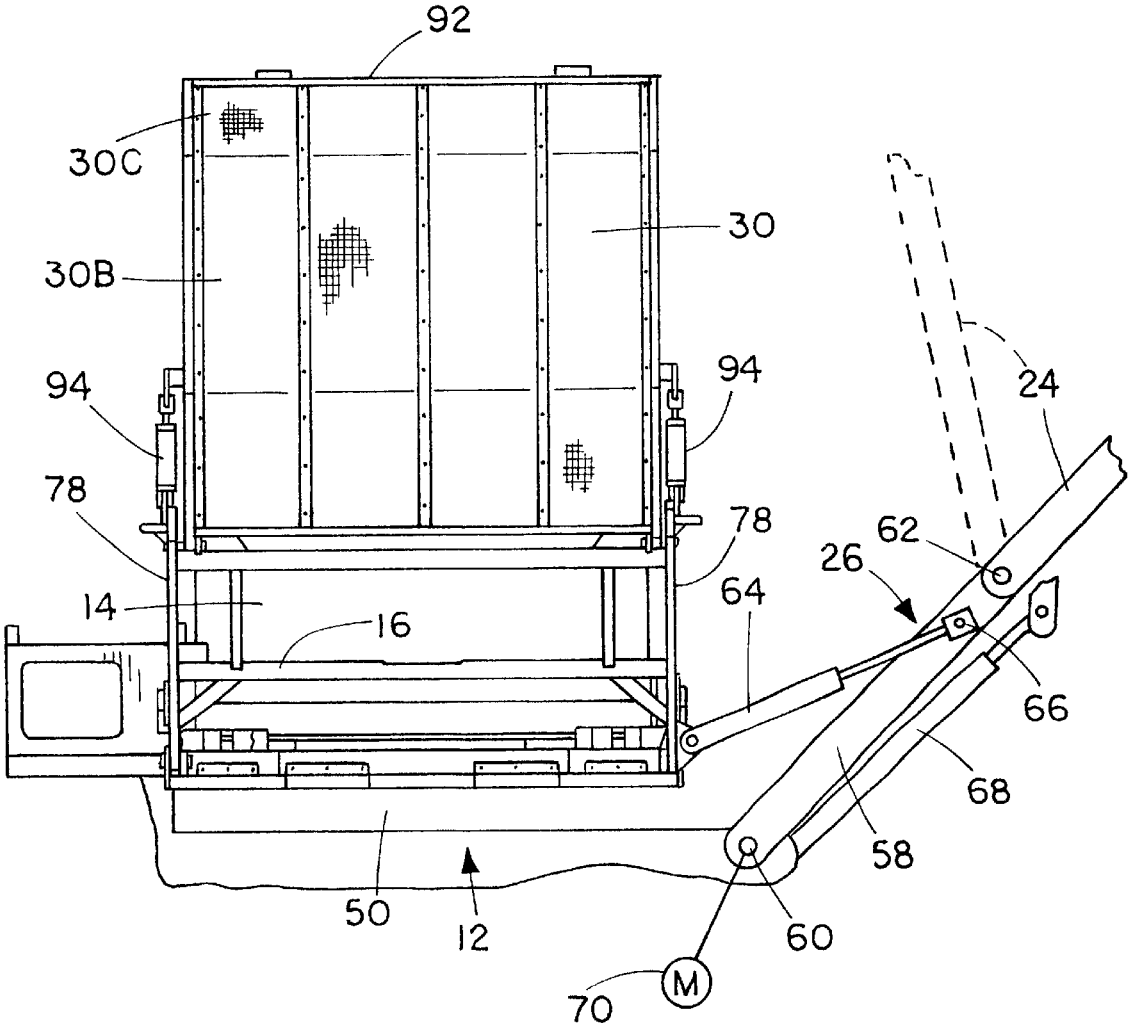
FIG. 3 is a part schematic side view showing a folding conveyor and taken on line 3—3 in FIG. 4.

As the material in the tub is ground, it will pass through a suitable screen 48 shown schematically, and drop down onto a horizontal conveyor 50 shown in FIGS. 4 and 5 schematically. The material is then carried rearwardly, to a lift conveyor that again is shown schematically in FIG. 3 and is indicated at 26. The conveyor 26 is made in sections, includes the base section 58, as well as the outer end section 24. The base conveyor section 58 is pivotally mounted to the main frame 16 at a pivot 60 for example, and the outer conveyor section 24 is pivotally mounted to the outer end of the base conveyor section 58 at a pivot 62. The base conveyor section 58 is moved about its pivot 60 with a double acting hydraulic cylinder 64, that is connected to the frame 16 and has its rod end connected at 66 to the base conveyor section. The base conveyor section can be pivoted from a generally upwardly inclined position as shown in FIG. 3, to a substantially vertical position at the rear of the tub 14. The pivoting of the outer end section 24 of the conveyor 26 about pivot 62 is controlled with a double acting hydraulic cylinder 68, so it can be pivoted to a position generally inverted and horizontal when the base conveyor section is vertical, and an intermediate position as shown in dotted lines in FIG. 3. The conveyor is folded for travel and storage. The conveyor is powered in a suitable manner for example by a hydraulic motor 70.

Figure 2:
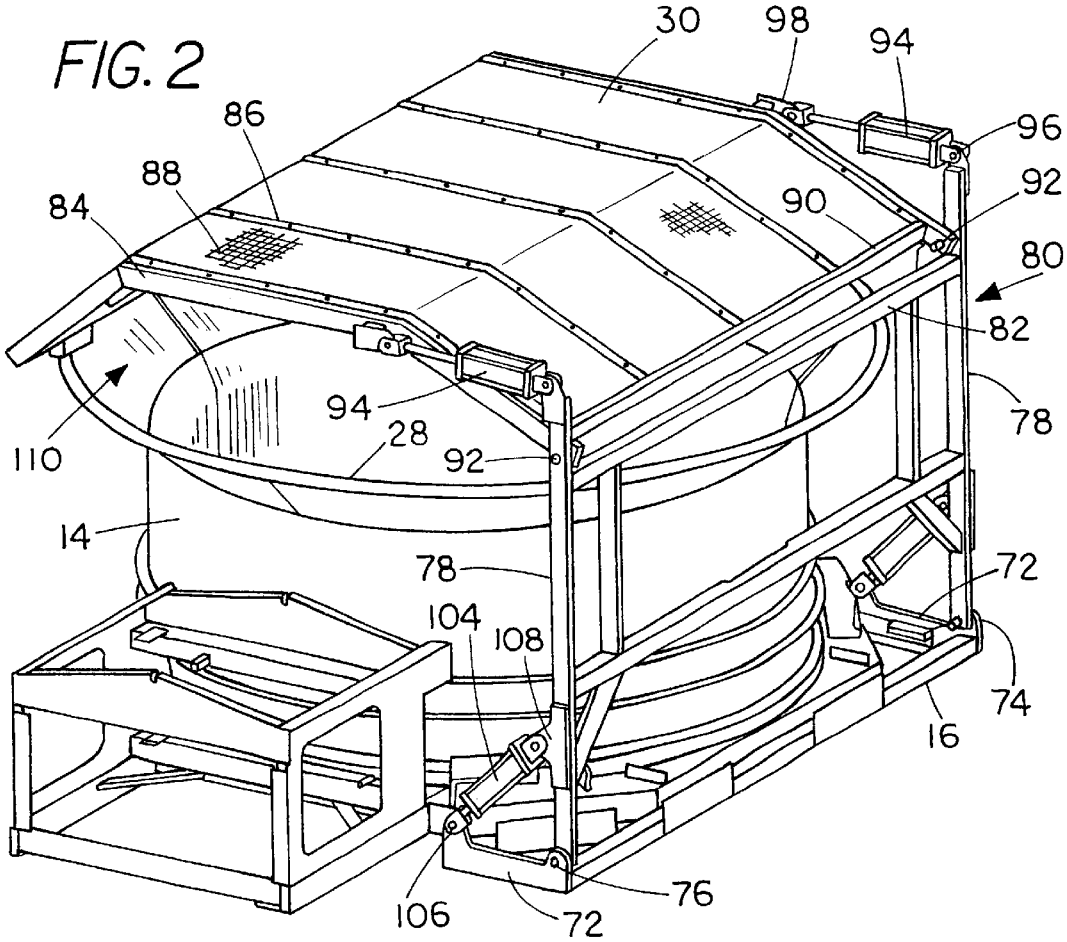
FIG. 2 is a fragmentary perspective view of the tub grinder of the present invention, showing the cover member in a closed or covering position.

The cover assembly 22, which includes the outer cover section 30, is mounted to the main frame 16, as can perhaps best be seen in FIG. 2. The frame 16 has laterally extending sections that support arms 72 at the front and rear of the tub grinder. The frame arms 72 have ear members 74 that have pivot pins 76 supporting upright members 78 of an upright cover frame assembly 80.

The upright cover frame assembly 80 has suitable cross members 82 thereon, so that the upright cover frame is rigid and will be a stable support for the outer cover section 30. The cover section 30 has side frame members 84 and intermediate frame members 86 that support suitable screen panels 88. The frame for the outer cover section 30 also has a base member 90 that is attached to the end frame members 84 and the intermediate members 86, and also has an outer end cross member 92 as can be seen in FIG. 3 for example to hold the frame section together. The screen panels 88 can be attached in a suitable manner so that they can be replaced if damaged. The outer cover section 30 is pivotally mounted to the upright frame members 78 on suitable pivot pins 92 that form a horizontal pivot axis. The outer cover section 30 can be tilted relative to the upright frame 80 through the use of double acting hydraulic actuators or cylinders 94 that are mounted to the upright members 78 at pins 96. The rod ends of cylinders 94 are connected to the outer cover section 30 with suitable brackets 98. The hydraulic actuators 94 are operated through controls indicated at 100, and these controls include valves that control hydraulic fluid under pressure from a pump 102 to the cylinders.

The tilting of the upright cover frame assembly 80 is controlled by hydraulic actuators or cylinders 104, that are mounted as at 106 to inner ends of the arms 72. The rod ends of cylinder 104 are connected to brackets 108 on the upright frame members 78.

The open top of the tub is shown at 110 in FIG. 2. The open top is where material to be ground is introduced into the tub 14 for grinding with the grinding cylinder 38. The open top 110 has to be accessible for loading the tub with material to be ground.

The positions of the cover assembly in addition to the position shown in FIGS. 1 and 2 where the outer cover section 30 is overlying substantially the entire opening 110 of the tub 14, include the solid line position shown in FIG. 4 where the upright cover frame assembly 80 is substantially vertical, with the cylinders or actuators 104 retracted, and the outer cover section 30 is in its fully opened position with the actuators 94 retracted. The dotted line position shown in FIG. 4 for the outer cover section 30 is with the actuators 94 extended, and the outer end section 24 of the conveyor 26 is also illustrated in FIG. 4 in dotted lines.

With the upright frame 80 generally vertical, and the outer cover section 30 raised, as shown in FIG. 4, it can be seen that material being thrown out of the tub toward the frame side (which is the direction material will travel from rotation of the grinding cylinder) will be intercepted by the screen portions of the outer cover section 30 and will drop back into the tub. For example an object indicated at 114 is shown in dotted lines. The outer cover section 30 extends upwardly a substantial distance, as shown, to intercept objects deflected upwardly.

In the position shown in FIG. 4, with the cover section 30 fully open, that is with the cylinders 94 retracted, and the upright cover frame 80 vertical, the cover assembly is stable. The opening to the left side indicated by the bracket 116 is of substantial size so that the tub can be loaded from that side of the tub grinder, without further opening. The frame 80 can be tilted outwardly as shown in FIG. 5 for permitting long material that sticks out the sides of the tub to pass by. The frame normally is pivoted outwardly and would be put in the vertical position when the tub is being emptied and the tub coverage is to be maximized. In the position shown in FIG. 5, the outer cover section 30 extends upwardly sufficient so that items being thrown out of the tub are going to be intercepted, because of the high extension, and wide coverage area of the cover section 30. The tub cover is mounted on the tub frame and moves with the tub when the tub is raised for servicing or maintenance.

It should be noted that the outer cover section 30 is made into three parts, 30A, which is the section that is adjacent the upright frame 80, 30B which is a center section, and 30C which is a section that inclines downwardly from the section 30B. The unit thus forms a type of "dome" that provides space for the outer conveyor section 24 and at the same times serves to provide deflection of debris in its working positions. The screen panels used in the cover section are bolted in place so they can be changed if damages, or if a different material is desired. Solid material cover panels can be used as well.

Again, the amount of material in the tub can suppress or dampen the likelihood of an object to be thrown out of the tub and will stop or dampen its potential flight. The cover intercepts objects in its working positions, and can completely cover the tub opening so that there is no ejection of material. The position of the cover is easily controlled by the operator to suit existing conditions.

Although the present invention has been described with reference to preferred embodiments, workers skilled in the art will recognize that changes may be made in form and detail without departing from the spirit and scope of the invention.

What is claimed is:

1. A protective cover assembly for a tub grinder, said tub grinder having a main frame, a floor, a tub having an open top rotatably mounted on said frame over said floor, a power source for rotatable driving the tub, and a grinder cylinder mounted for rotation about a generally horizontal axis, a portion of the cylinder being exposed through a floor opening to engage material on the floor as the cylinder rotates, a movable cover mounting the cover assembly comprising a cover frame having pivots for pivotally mounting to the tub grinder main frame along a substantially horizontal axis at a level below the open top of the tub, the cover assembly having a cover section mounted on the cover frame, the cover frame being pivotable from a position with the cover section overlying at least portions of the tub to a position wherein the cover section assembly is laterally positioned relative to the tub.

2. The cover assembly of claim 1, wherein said cover frame has at least one upright member, and the cover section is pivotally mounted to said at least one upright member at a level at least generally above the top of the tub grinder with the least one upright member extending upwardly, and a power member for pivoting the cover section relative to the at least one upright member.

3. The cover assembly of claim 2, wherein said cover section has cover panels forming planes extending between side edges, the cover panels being positioned relative to each other at angles other than parallel to form a dome shape when the at least portions of the cover section overlie the top of the grinder tub.

4. The cover assembly of claim 3, wherein said cover section is of size to overlie substantially the entire open top of the grinder tub.

5. The cover assembly of claim 2, wherein said cover section is pivotally mounted to the at least one upright member about a generally horizontal pivot axis.

6. The cover assembly of claim 1, wherein the power member comprises a hydraulic actuator acting between the cover frame and the cover section for adjusting the angle of the cover section relative to the cover frame.

7. The cover assembly of claim 1, and hydraulic actuators for pivotally moving said cover frame about the pivots for mounting its pivot the tub grinder main frame.

8. A tub grinder and cover combination for providing a deflector and cover for the tub grinder, including a grinder tub, a main frame for supporting the grinder tub for rotation about a vertical axis, a grinding member on the interior of said grinder tub at the bottom of the grinder tub and rotating about a generally horizontal axis, a power drive for driving said grinding member, the grinding member operating to engage material in the grinder tub and grind such material, a cover assembly including a cover frame and a cover section, said cover frame being pivotally mounted to the grinder frame about a first generally horizontal axis, at a level substantially below an upper end of the grinder tub, the cover frame extending outwardly from the pivot, and the cover section being mounted to the cover frame about a second pivot axis at a location spaced from the first generally horizontal axis, and a power member for adjusting the pivotal position of the cover section relative to the cover frame.

9. The combination of claim 8, wherein said cover section has a series of panels that are formed at angles relative to each other and which have planes generally parallel to the second pivot axis.

10. The combination of claim 8, wherein said cover frame is movable about the first generally horizontal axis from a generally upright position in a direction away from said grinder tub to move the cover section to a location where it is out of registry with the grinder tub.

11. The combination of claim 8, wherein said cover section is of size to overlie substantially all of a top opening of the grinder tub with the cover frame in a generally upright position.

12. A cover for a tub grinder having an open top grinder tub comprising a cover frame having a pair of elongated frame members, pivots at fist ends of the frame members for mounting the frame members to a tub grinder frame about a cover frame pivot axis, a cover section mounted to second ends of said cover frame members, the cover section extended laterally from the cover frame members and being of size to cover a substantial portion of the open top of the grinder tub when the cover frame members are pivoted on the tub grinder frame and are substantially upright in a first position, the cover frame members being pivotable to a position offset from the first position with the laterally extending cover section in a position where at least a portion of the grinder tub is uncovered.

13. The cover of claim 12, wherein the cover section is pivotally mounted to the second ends of the cover frame members, and power members for controlling the pivotal position of the cover section relative to the cover frame members.

14. The cover of claim 13, wherein portions of the cover section spaced laterally from the cover frame member raises above the grinder tub as the cover section is pivoted away from a covering position, to the portions lifting away from a grinder tub of a grinder on which the frame members are mounted, and the cover section raised above the grinder tub providing a deflector for objects ejected from such grinder tub.

* * * * *